US005343566A

United States Patent [19]

Solheim et al.

[11] Patent Number: 5,343,566

[45] Date of Patent: Sep. 6, 1994

[54] METHOD OF MAKING GOLFER'S PROTECTIVE MITTEN

[75] Inventors: John A. Solheim, Phoenix; Nip T. Lim, Glendale, both of Ariz.

[73] Assignee: Karsten Manufacturing Corporation, Phoenix, Ariz.

[21] Appl. No.: 180,140

[22] Filed: Jan. 11, 1994

Related U.S. Application Data

[62] Division of Ser. No. 936,794, Aug. 28, 1992.

[51] Int. Cl.[5] ..... A41D 19/02

[52] U.S. Cl. ..... 2/169; 2/158

[58] Field of Search ..... 2/16, 159, 161.1, 161.2, 2/162, 158, 169

[56] References Cited

U.S. PATENT DOCUMENTS

| | | | |
|---|---|---|---|
| 1,280,421 | 10/1918 | Diem | 2/158 |
| 1,417,323 | 5/1922 | Hollenbeck | 2/158 |
| 2,809,376 | 10/1957 | Winson | 2/158 |
| 3,114,915 | 12/1963 | Gross | 2/158 |
| 3,711,889 | 1/1973 | Jennings | 2/158 |
| 4,194,248 | 3/1980 | Verschaeve | 2/158 |
| 4,411,026 | 10/1983 | Secter | 2/158 |
| 4,662,006 | 5/1987 | Ross, Jr. | 2/158 |

*Primary Examiner*—Clifford D. Crowder
*Assistant Examiner*—Michael A. Neas
*Attorney, Agent, or Firm*—Herbert E. Haynes, Jr.; Darrell F. Marquette

[57] ABSTRACT

A protective mitten for golfers has a finger receiving portion, a thumb receiving portion and a wrist receiving portion. The mitten includes an outer shell made of water resistant material such as nylon, a lining made of insulating material such as synthetic shearling disposed inside the outer shell, and a strip of resilient material such as foam rubber attached to the outer shell extending circumferentially of the wrist receiving portion of the mitten. The strip of resilient material is disposed between the outer shell and the lining. A method of making the mitten includes providing a pair of hand shaped blanks, sewing the blanks together on a seam which extends adjacent first side edges of the blanks, attaching the strip of resilient material to the blanks such that it extends substantially between the side edges of each blank, folding the blanks into a face-to-face, inside-out relationship with the strip of resilient material facing outwardly, sewing the blanks together on another seam which extends adjacent the side edges and the top edges of the blanks to form the outer shell which is inside-out, turning the outer shell right-side-out so that the strip of resilient material and the seams are facing inwardly, and inserting the lining into the outer shell.

7 Claims, 2 Drawing Sheets

METHOD OF MAKING GOLFER'S PROTECTIVE MITTEN

This is a divisional of copending application(s) Ser. No. 07/936,794 filed on Aug. 28, 1992.

BACKGROUND OF THE INVENTION

This invention relates generally to apparel and, in particular, to a protective mitten designed especially for golfers and a method of making the mitten.

When playing golf in cold weather, golfers need to keep their hands warm between shots in order to play effectively. In wet weather, golfers need to keep their hands dry. Protective gear is readily available for a golfer's body but the hands are usually neglected. Conventional foul weather gloves and mittens are impractical because they become a nuisance when they have to be put on and taken off many times during a round of golf. Furthermore, it is difficult to use conventional foul weather gloves and mittens while wearing a tightly fitting golf glove.

SUMMARY OF THE INVENTION

It is an object of the present invention to provide a protective mitten for golfers which will keep their hands warm and dry.

Another object of the present invention is to provide a protective mitten for golfers which may be put on and taken off easily and quickly even while wearing a tightly fitting golf glove.

A protective mitten according to the present invention has a finger receiving portion, a thumb receiving portion and a wrist receiving portion. The protective mitten includes an outer shell made of water resistant material, a lining made of insulating material disposed inside the outer shell, and a strip of resilient material attached to the outer shell and extending circumferentially of the wrist receiving portion. The strip of resilient material is disposed between the outer shell and the lining.

According to the present invention, a method of making a protective mitten includes providing a pair of hand shaped blanks wherein each of the blanks has a finger section, a thumb section and a wrist section. A strip of resilient material is attached to the wrist sections of the blanks in a manner such that the strip of resilient material extends substantially between first and second side edges of each blank. Then the blanks are folded into a face-to-face, inside-out relationship with the strip of resilient material facing outwardly. Next, the blanks are sewn together on a seam which extends adjacent their first side edges, adjacent their top edges and adjacent their second side edges in order to form an outer shell which is inside-out. The outer shell is then turned right-side-out so that the strip of resilient material and the seam are facing inwardly. Finally, the lining is inserted into the outer shell.

DESCRIPTION OF THE PREFERRED EMBODIMENT

Figure 1:
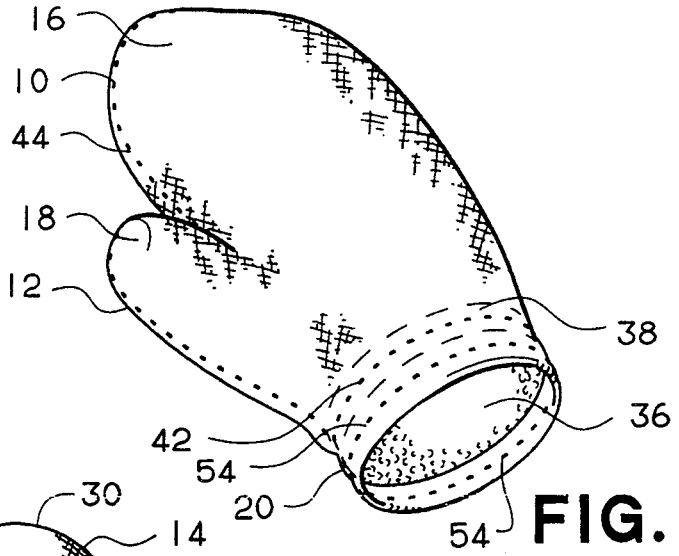
FIG. 1 is a perspective view of a protective mitten according to the present invention including an outer shell made of water resistant material and a lining made of insulating material.
Figure 2:
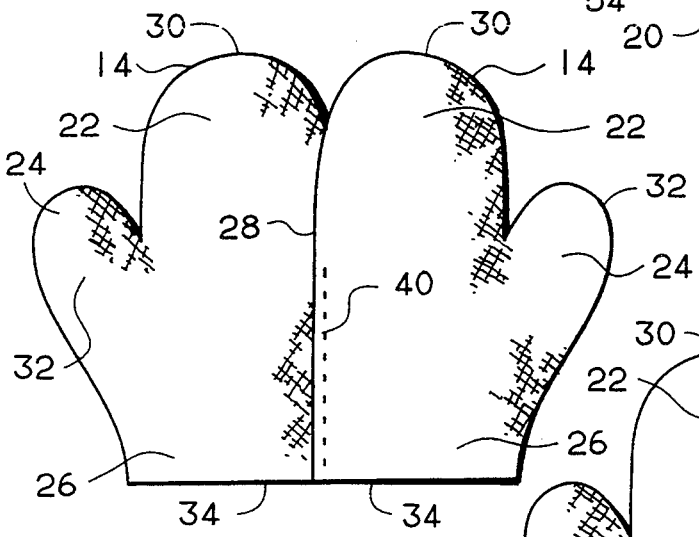
FIG. 2 is a plan view illustrating one step of a method according to the present invention wherein two identical hand shaped blanks used in making the outer shell of the protective mitten shown in FIG. 1 have been sewn together on a seam which extends adjacent side edges of the blanks.

A protective mitten 10 (FIG. 1) especially for golfers includes an outer shell 12 consisting of a pair of identical hand shaped blanks 14 (FIG. 2) made of water resistant material such as nylon. With the outer shell 12 right-side-out as seen in FIG. 1, the nylon has a finely textured outside surface and a relatively smooth inside surface. The outer shell 12 has a finger receiving portion 16, a thumb receiving portion 18 and a wrist receiving portion 20. Each of the blanks 14 has a finger section 22, a thumb section 24 and a wrist section 26. The blanks 14 each have a first side edge 28 extending along the finger and wrist sections 22 and 26, a top edge 30 extending along the finger section 22, a second side edge 32 extending along the finger, thumb and wrist sections 22, 24 and 26, and a bottom edge 34 extending along the wrist section 26. In order for the mitten 10 to fit any size hand, the sections 22, 24 and 26 of the blanks are oversized.

Figure 5:
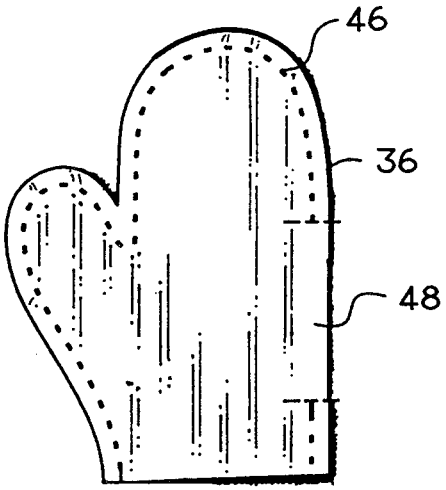
FIG. 5 is a plan view of a lining that is disposed inside the outer shell of the protective mitten shown in FIG. 1.

A lining 36 (FIG. 5) made of insulating material such as fabric known as synthetic shearling is disposed inside the outer shell 12. When the lining 36 is right-side-out as seen in FIG. 5, the shearling has a furry inside surface which will contact a golfer's hand, and a smooth outside surface which will contact the inside surface of the nylon forming the outer shell 12. The lining 36 has finger, thumb and wrist receiving portions which correspond to the finger, thumb and wrist receiving portions 22, 24 and 26 of the outer shell 12. A strip 38 of resilient material (e.g. foam rubber) is attached, preferably by sewing, to the outer shell 12 and extends circumferentially of the wrist receiving portion 20 of the mitten 10 as illustrated in FIG. 1. The strip 38 of resilient material is disposed between the outer shell 12 and the lining 36.

Figure 3:
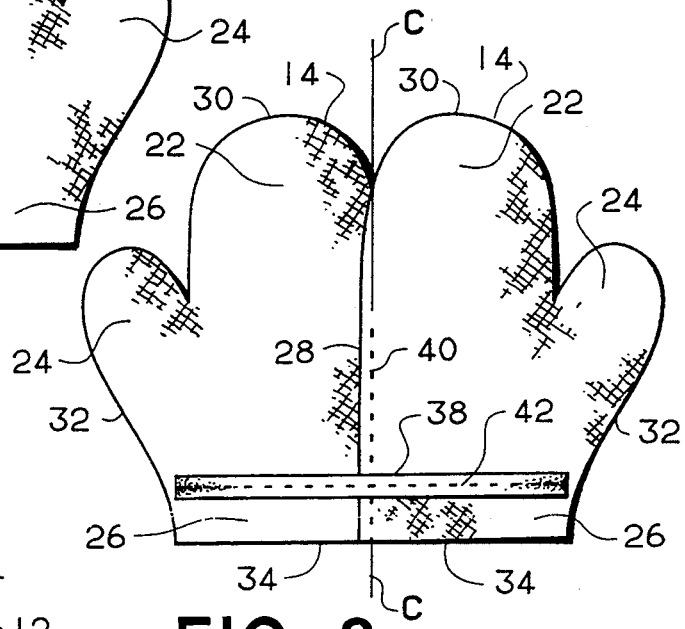
FIG. 3 is a plan view illustrating another step of the method according to the present invention wherein a strip of resilient material has been attached to the hand shaped blanks shown in FIG. 2.
Figure 4:
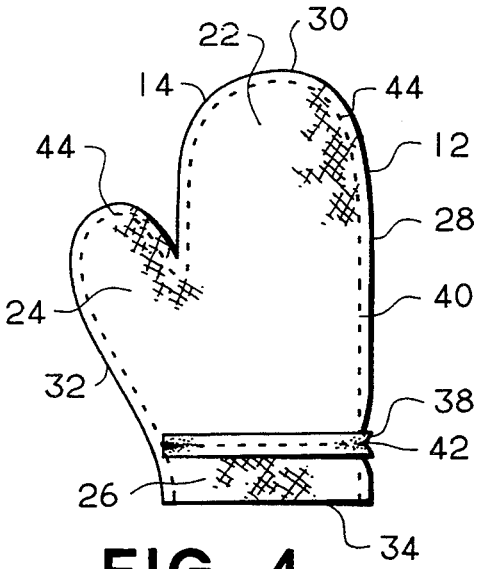
FIG. 4 is a plan view illustrating a further step of the method according to the present invention wherein the two hand shaped blanks shown in FIG. 2 have been folded into a face-to-face, inside-out relationship and then sewn together on another seam that extends adjacent side and top edges of the blanks to form the outer shell of the protective mitten.

The initial step in making the mitten 10 is to sew the blanks 14 together on a seam 40 which extends approximately ten inches adjacent their first side edges 28. Alternatively, a single blank (not shown) which has the same shape as the two sewn together blanks 14 could be used, thus eliminating the sewing of the seam 40. The blanks 14 are then arranged side-by-side so that each blank is a mirror image of the other blank when lying flat and seen in plan view in FIG. 2. The strip 38 of resilient material is sewn to the wrist sections 26 of the blanks 14 on a seam 42 in a manner such that the strip 38 of resilient material extends substantially between the first and second side edges 28, 32 of each blank 14 as seen in FIG. 3. Next, the blanks 14 are folded about axis C (FIG. 3) into a face-to-face, inside-out relationship with the strip 38 of resilient material facing outwardly. The blanks 14 are sewn together on a seam 44 (FIG. 4) which extends adjacent the first side edges 28, the top edges 30 and the second side edges 32. This forms the outer shell 12 which is inside-out. The next step in making the mitten 10 is to turn the outer shell 12 right-side-out so that the strip 38 of resilient material and the seams 40, 44 are facing inwardly.

Meanwhile, the lining 36 (FIG. 5) is formed by sewing together two identical hand shaped blanks of synthetic shearling on a seam 46 such that the lining 36 is right-side-out. The seam 46 has an opening 48 left therein along one side of the finger receiving portion of the lining 36 for a purpose which is described later. The opening 48 is opposite the thumb receiving portion of the lining 36.

Figure 6:
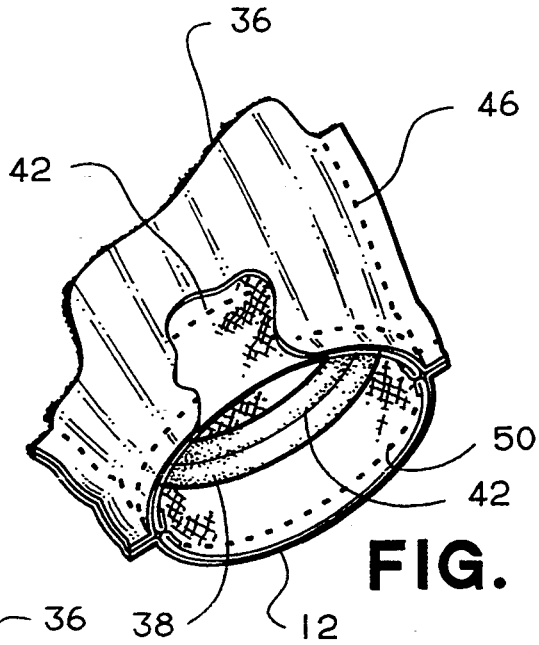
FIG. 6 is a perspective view illustrating a step of the method according to the present invention wherein the outer shell has been turned right-side-out and then inserted into the lining which is also right-side-out.
Figure 7:
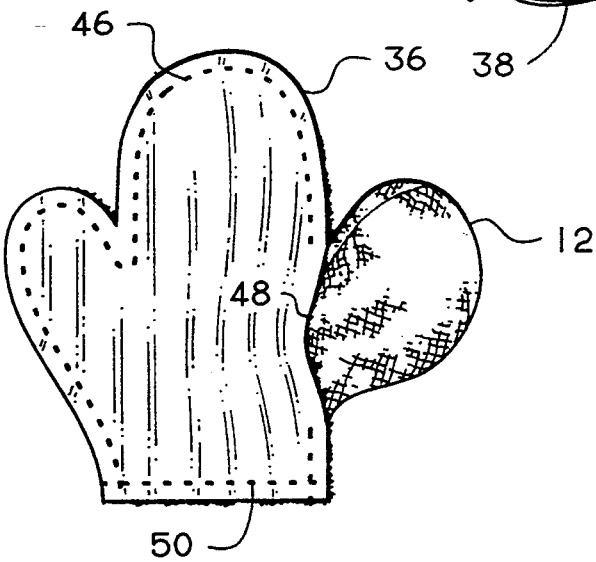
FIG. 7 is a view illustrating another step of the method according to the present invention wherein the outer shell is pulled outwardly through an opening in one side of the lining.
Figure 8:
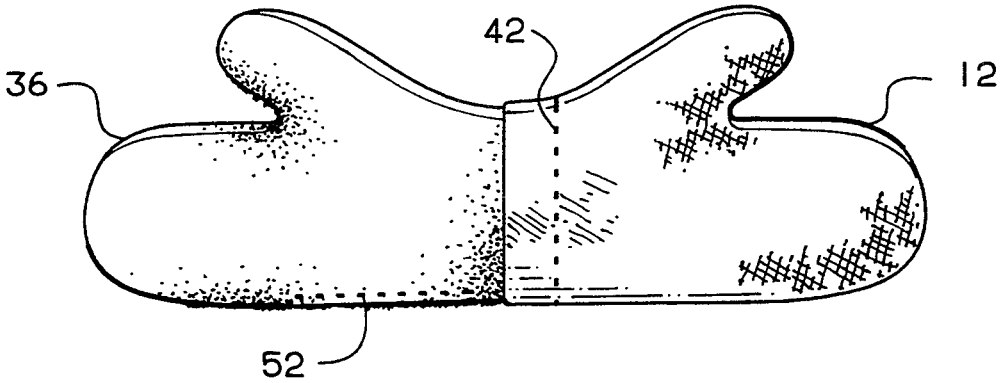
FIG. 8 is a view illustrating the relationship between the outer shell and the lining after the step illustrated in FIG. 7 has been completed.

The next step in the making of the mitten 10 is to insert the outer shell 12 which is turned right-side-out into the lining 36 which is also right-side-out as shown in FIG. 6. The outer shell 12 and the lining 36 are then stitched together on a seam 50 which extends adjacent the bottom edges 34 of the blanks 14. The outer shell 12 is then pulled outwardly through the opening 48 in the seam 46 of the lining 36 as illustrated in FIG. 7 until the outer shell 12 is completely removed from the lining 36. As the outer shell 12 is pulled through the opening 48, the lining 36 will also be pulled through the opening 48 thus turning the lining 36 inside-out as illustrated in FIG. 8. The opening 48 is closed by stitching at 52. Next, the lining 36 is inserted into the outer shell 12 so that both the outer shell 12 and the lining 36 are right-side-out as seen in FIG. 1, and the seams 40, 44, 46, 50 are hidden from view. The final step in the making of the mitten 10 is to sew a seam 54 circumferentially of the wrist receiving portion 20 thereof substantially parallel to the seam 42 that attaches the strip 38 of resilient material to the outer shell 12.

Since the lining 36 is only attached to the outer shell 12 by the seam 50, the lining 36 may be pulled out of the outer shell 12 and turned inside out as shown in FIG. 8. This is helpful when it is desired to remove the lining 36 from the outer shell 12 for cleaning.

While the strip 38 of resilient material has enough resiliency to loosely grip a person's wrist, it also allows the mitten 10 to be put on and taken off easily and quickly while preventing the mitten 10 from slipping off inadvertently.

It will be understood that the completed mitten 10 as shown in FIG. 1 is universal and therefore may be used on either a right hand or a left hand.

What is claimed is:

1. A method of making a protective mitten having a finger receiving portion, a thumb receiving portion and a wrist receiving portion, said method comprising the steps of:

providing a pair of hand shaped blanks made of water resistant material wherein each of said blanks has a finger section, a thumb section, a wrist section, a first side edge extending along said finger and wrist sections, a top edge extending along said finger section, a second side edge extending along said finger, thumb and wrist sections, and a bottom edge extending along said wrist section;

attaching a strip of resilient material to the wrist sections of said blanks in a manner such that said strip of resilient material extends substantially between said first and second side edges of each blank;

folding said blanks into a face-to-face, inside-out relationship with said strip of resilient material facing outwardly;

sewing said blanks together on a seam which extends adjacent said first side edges, adjacent said top edges and adjacent said second side edges in order to form an outer shell which is inside-out;

turning said outer shell right-side-out so that said strip of resilient material and said seam are facing inwardly and wherein said strip of resilient material extends circumferentially of the wrist receiving portion of the mitten; and inserting a lining made of insulating material into said outer shell, said inserting step being performed after said turning step has been completed and including initially inserting said outer shell into said lining which is right-side-out.

2. The method of claim 1, further comprising the step of attaching said lining to said outer shell only at said wrist receiving portion.

3. The method of claim 1, further comprising the step of arranging said blanks side-by-side prior to said attaching step so that each blank is a mirror image of the other blank when lying flat and seen in plan view.

4. The method of claim 1, further comprising the step of sewing said blanks together on a seam which extends adjacent said first side edges prior to said attaching step.

5. The method of claim 1 wherein said inserting step further includes sewing said lining to said outer shell, after inserting said outer shell into said lining, on a seam which extends adjacent said bottom edges of said blanks.

6. The method of claim 5, wherein said inserting step also includes pulling said outer shell and said lining outwardly through an opening in one side of said lining, after sewing said lining to said outer shell, until said outer shell is right-side-out and said lining is inside-out.

7. The method of claim 6, wherein said inserting step includes closing said opening in said lining after said pulling is completed.

* * * * *